United States Patent [19]

Langlitz et al.

[11] 4,014,530

[45] Mar. 29, 1977

[54] PROTECTIVE NOZZLE FOR METALLURGIC VESSELS, PARTICULARLY FOR STEEL MILL CONVERTERS

[75] Inventors: Karlheinz Langlitz, Mulheim; Günter Schmitz, Duisburg, both of Germany

[73] Assignee: Demag Aktiengesellschaft, Duisburg, Germany

[22] Filed: July 23, 1976

[21] Appl. No.: 708,225

[30] Foreign Application Priority Data

Aug. 1, 1975 Germany ..... 2534331

[52] U.S. Cl. ..... 266/241

[51] Int. Cl.[2] ..... C21C 5/46

[58] Field of Search ..... 266/241, 243, 245–247, 266/280, 285, 286

[56] References Cited

UNITED STATES PATENTS 3,799,524 3/1974 Meny ..... 266/241

*Primary Examiner*—Gerald A. Dost

*Attorney, Agent, or Firm*—Mandeville and Schweitzer

[57] ABSTRACT

The invention covers a protective nozzle for metallurgic vessels, particularly for steel mill converters which are provided with a frontal ring, connected to the vessel shell and reinforcing the nozzle for attachment of the nozzle ring, whereby the latter consists of interchangeable ring segments; also provided is forced cooling.

3 Claims, 2 Drawing Figures

Fig.1
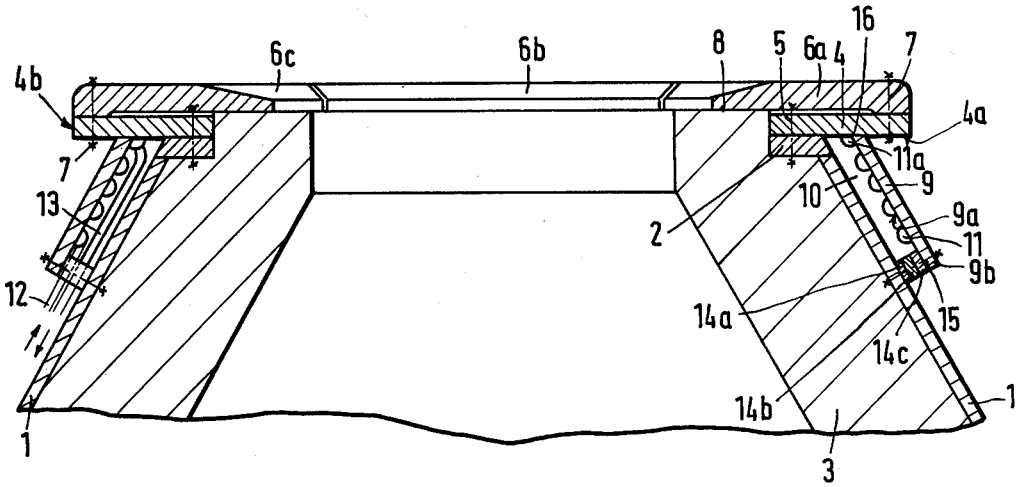
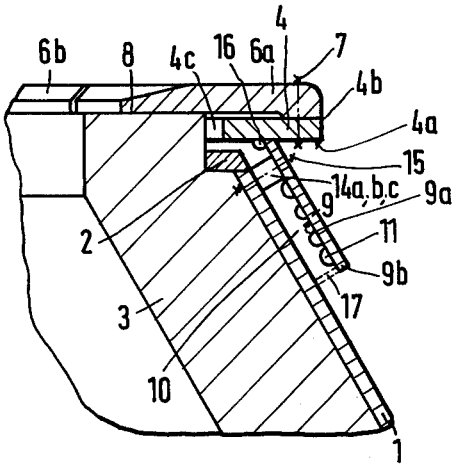
Fig.2

PROTECTIVE NOZZLE FOR METALLURGIC VESSELS, PARTICULARLY FOR STEEL MILL CONVERTERS

BACKGROUND AND STATEMENT OF THE INVENTION

Such nozzle protection eliminates deformation of the vessel shell and serves to receive forces necessary to remove the so-called slag tups. From past experience we know that slag tups on Thomas, LD and LDAC converters are inevitable. The annular segments are either welded or cast. The annular segments, mostly consisting of hematite iron have great surface hardness resulting from cooling of the scale. They tend less to stick to the discharge resulting from the metallurgic process than those nozzle rings that are made of welding steel. Deposits of slag and/or metal spray which may still occur can generally be removed with pneumatic hammers or special hooks which do not cause any major damage to the ring segments. If there is any damage to the nozzle rings, usually only one segment is affected which may then be replaced independently.

A nozzle ring having cooling water passages or ducts has already been suggested (DT-AS 1 302 880) for protection of the vessel nozzle. This known nozzle ring has a hook-shaped profile, whereby one portion, radially directed inward, forms a part of the frontal face of the nozzle, and the other portion is adapted to the slant of the vessel wall, both portions being arranged at a distance from the vessel wall to form an air gap between themselves and the vessel wall. The disadvantage of this arrangement is that the water cooling is located directly in the converter nozzle. The slag tups are separated from the cooling medium only by the wall thickness of the ring with the cooling medium passages. Loosening of the slag tups may lead to leaking, caused by puncture, of the ring containing the cooling medium. This danger is sufficient to prohibit practical use of the known ring containing cooling water passages. Leakage of cooling water at the superheated nozzle area of a metallurgic vessel, from which waste gases escape, would inevitably lead to explosions in the flue gas stack and/or vessel itself.

In today's technology, it has only been established to protect the vessel shell in the nozzle area from excessive thermal stress caused by heat radiation. The present invention, however, provides a forced-cooled protective nozzle where, on one hand, the advantages of ring segments which can be subjected to great mechanical stress, can be exploited and where, on the other hand, the disadvantage of rings with cooling water passages which are threatened by mechanical stress, can be avoided.

The invention solves this by providing a solid supporting ring which carries the annular segments and which is indirectly connected to the vessel shell; a tubular annular shield connected with the supporting ring forming a hollow space around the vessel shell, with water passages arranged within, which are firmly connected to the annular shield, and which however, do not have any attachment to the vessel shell; the supporting ring having an externally protruding rim next to the connection with the annular shield and the rim being fitted with means of attaching the annular segments, such means of attachment being accessible from the exterior.

Starting with the advantages of the annular segments, the advantages of the invention consist of a larger bearing surface made possible by the supporting ring, furthermore in the tubular annular shield which constitutes a quasi "double hood" for the conical portion of a converter. The protected bottom of this annular shield is used to accommodate the cooling water pipes. While the slag tups form smaller deposits on the enlarged annular segments and can be removed more easily, there is no danger of damaging pipes carrying cooling water from mechanical stress on the annular segments. The protective nozzle of the invention is therefore more durable under extreme conditions than the one known heretofore. The invention does, however, also increase safety during operation: despite all safety measures pipes carrying cooling water may leak and even during inverted position of the vessel its contents may only drip into the trough formed by vessel shell and annular shield. In the upright position of the vessel the leaking water runs over the vessel shell as far as it does not evaporate. In this manner the protective nozzle according to the invention guarantees safe operation by keeping any risk to a minimum.

The hollow space containing the pipes carrying cooling water most likely decreases in most instances, due to the pressure on the vessel shell caused by exchange of the masonry, until the vessel shell rests on the pipes. The rounded shape of the pipes, however, makes them strong enough so that expansion of the annular shield is more likely. One improvement on the invention provides the cooling water pipes with half-profile or semicylindrical cross sections, the cross sectional edges adhering to the bottom of the annular shield, thus forming a seal. Another improvement on the invention is that supporting ring and annular shield are connected by a welding seam, with one of the pipes circulating cooling water arranged in this area.

DESCRIPTION OF THE DRAWINGS

The drawings illustrate the invention in conjunction with a steel mill converter of the pressurized oxygen type.

FIG. 1 is a vertical axial section through the nozzle area of a steel mill converter fitted with a protective nozzle embodying the invention; and FIG. 2 is a vertical axial section through the nozzle area of a steel mill converter illustrating a further embodiment of the invention.

DETAILED DESCRIPTION OF THE INVENTION

Frontal ring 2 is connected to vessel shell 1 (FIG. 1). Frontal ring 2 partially supports masonry 3 at the nozzle end surface. Furthermore, supporting ring 4 is attached to frontal ring 2 by means of screws 5 or like connection as will be understood. Supporting ring 4 carries individual annular segment 6*a*, 6*b*, 6*c*, and is connected with annular segments 6 by means of screws 7 or like connection. Annular segments 6*a* through 6*c* form the actual nozzle ring which is subjected to mechanical stress or impacts. The annular segments also form a support at 8 for that portion of masonry 3 which is not covered by frontal ring 2. Bottom 4*a* of supporting ring 4 is connected with tubular annular shield 9. Together with vessel shell 1 it forms hollow space 10. Bottom 9*a* of annular shield 9 has welded onto it several pipes 11 carrying cooling water, thus safely protecting the cooling water pipes from puncture. Pipes 11 either form one single pipe coil helical arrangement with one inlet pipe 12 and one outlet pipe 13, or several circular pipe strands, each featuring one inlet pipe 12 and one outlet pipe 13.

Annular shield 9 is at several points over the circumference supported at bottom 9*b* by several separate plates 14*a*, 14*b* and 14*c*. The number of mating plates 14 depends on the actually resulting distance between bottom 9*b* at annular shield 9 and vessel shell 1. Vessel shell 1, annular shield 9 and plates 14 are connected (as indicated) by means of attachment 15. This type of attachment is particularly advantageous in that the passage for cooling water inlet and outlet pipes 12 and 13 respectively is maintained even if vessel shell 1 is expanded by the pressure caused by the masonry where hollow space 10 practically disappears completely during the time of operation of the converter. Rim 4*b* protruding externally of supporting ring 4 permits easy access to means of attachments 7. Also particularly advantageous is corner weld 16 between annular shield 9 and supporting ring 4 which corner weld 16 is cooled by pipe 11*a* carrying cooling water.

The variation of FIG. 2 shows a supporting ring 4 which rests its interior circumference 4*c* neither on masonry 3 nor on frontal ring 2. Supporting ring 4 is indirectly connected to vessel shell 1 via annular shield 9 and mating plates 14 which form a spacer. This connection between supporting ring 4 and vessel shell 1 ensures a continuing independent heat expansion of the protective nozzle v. the metallurgic vessel. Hollow space 10 does not require any special cooling by air from the vicinity of the vessel. Annular shield 9 may therefore be either partially or totally closed by a support or cover plate 17.

I claim:

1. A protective nozzle for metallurgic vessels such as steel mill converters, comprising a. a vessel shell;

b. a frontal ring connected to the end face of said vessel shell opening;

c. a plurality of semi-annular nozzle ring segments forming an annular nozzle ring; the improvement characterized by d. a solid annular supporting ring disposed between said frontal ring and said annular nozzle ring, said supporting ring supporting said segments;

e. said supporting ring extending radially beyond said vessel shell to form an annular radial extension;

f. an annular shield depending from said supporting ring and spaced from said vessel shell to form a hollow space therebetween;

g. cooling water circulation means disposed in said hollow space, said circulation means connected to said shield; and h. means for attaching said segments to said annular radial extension, said attaching means being accessible at the bottom surface of said supporting ring.

2. The apparatus of claim 1, further characterized by a. said cooling water means includes semi-cylindrical cooling water tubes; and b. the flat surfaces of said tubes are joined to the surface of said shield.

3. The apparatus of claim 2, further characterized by a. a welding seam disposed at the connection between said supporting ring and said shield; and b. one of said cooling water tubes is disposed adjacent said seam.

* * * * *